US011774894B2

(12) United States Patent
Suzuki et al.

(10) Patent No.: US 11,774,894 B2
(45) Date of Patent: Oct. 3, 2023

(54) IMAGE FORMING APPARATUS CAPABLE OF DETERMINING WHETHER TO ORDER NEW DRUM CARTRIDGE TOGETHER WITH NEW TONER CARTRIDGE

(71) Applicant: BROTHER KOGYO KABUSHIKI KAISHA, Nagoya (JP)

(72) Inventors: Takashi Suzuki, Nagoya (JP); Tadao Kyotani, Nagoya (JP); Shingo Fujiwara, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/582,336

(22) Filed: Jan. 24, 2022

(65) Prior Publication Data

US 2022/0146973 A1 May 12, 2022

Related U.S. Application Data

(63) Continuation of application No. PCT/JP2020/031978, filed on Aug. 25, 2020.

(30) Foreign Application Priority Data

Aug. 30, 2019 (JP) ..... 2019-158321

(51) Int. Cl.
*G03G 15/00* (2006.01)
*G03G 15/08* (2006.01)
*G03G 21/18* (2006.01)

(52) U.S. Cl.
CPC ..... *G03G 15/556* (2013.01); *G03G 15/5079* (2013.01); *G03G 15/0856* (2013.01); *G03G 21/1882* (2013.01)

(58) Field of Classification Search
CPC ..... G03G 15/556; G03G 15/0856; G03G 15/5079; G03G 15/5016; G03G 15/0863;
(Continued)

(56) References Cited

U.S. PATENT DOCUMENTS 5,066,978 A * 11/1991 Watarai ..... G03G 15/553 399/24
5,196,884 A 3/1993 Sugiyama
(Continued)

FOREIGN PATENT DOCUMENTS

JP 3-200980 A 9/1991
JP 10-309851 A 11/1998
(Continued)

OTHER PUBLICATIONS

International Preliminary Report on Patentability and Written Opinion of the International Searching Authority issued in corresponding International Patent Application No. PCT/JP2020/031978, dated Mar. 1, 2022.
(Continued)

*Primary Examiner* — Robert B Beatty
(74) *Attorney, Agent, or Firm* — Merchant & Gould P.C.

(57) ABSTRACT

An image forming apparatus includes: a main body; a drum cartridge and a toner cartridge those attachable to the main body; a main memory; and a controller. The controller is configured to perform: determining a number of sheets printable using the toner cartridge attached to the main body; determining a number of sheets printable using the drum cartridge attached to the main body; determining a number of sheets printable using a new toner cartridge; and when determining that a sum of the number of sheets printable using the toner cartridge attached to the main body and the number of sheets printable using a new toner cartridge is greater than or equal to the number of sheets printable using
(Continued)

the drum cartridge attached to the main body, transmitting to a server a signal for ordering a new drum cartridge together with a new toner cartridge.

9 Claims, 8 Drawing Sheets

(58) Field of Classification Search
CPC ..... G03G 15/553; G03G 21/1875; G03G 21/1878; G03G 21/1889; G03G 2215/0695; G03G 2215/0697; G03G 2221/1663; G03G 2221/1823
USPC ..... 399/24, 25, 26, 27, 43, 81
See application file for complete search history.

(56) References Cited

U.S. PATENT DOCUMENTS

| | | | | |
|---|---|---|---|---|
| 2002/0002480 | A1 | 1/2002 | Sato et al. | |
| 2002/0049839 | A1 | 4/2002 | Miida et al. | |
| 2002/0131784 | A1 | 9/2002 | Takemoto | |
| 2002/0143893 | A1 | 10/2002 | Nakazono et al. | |
| 2003/0040984 | A1 | 2/2003 | Inami et al. | |
| 2005/0117918 | A1* | 6/2005 | Kimura | G03G 21/1878 399/24 |
| 2006/0067717 | A1* | 3/2006 | Yokogawa | G03G 15/55 399/26 |
| 2006/0228123 | A1 | 10/2006 | Zaima | |
| 2007/0122164 | A1 | 5/2007 | Shiori et al. | |
| 2008/0316533 | A1 | 12/2008 | Kawai | |
| 2011/0013916 | A1* | 1/2011 | Katoh | G03G 15/553 399/25 |
| 2012/0014700 | A1 | 1/2012 | Matsumoto et al. | |
| 2012/0176636 | A1 | 7/2012 | Ormond | |
| 2013/0039668 | A1* | 2/2013 | Takahashi | G03G 15/0863 399/113 |
| 2013/0108285 | A1* | 5/2013 | Spink | G03G 15/556 399/24 |
| 2015/0003847 | A1 | 1/2015 | Yang et al. | |
| 2015/0019386 | A1 | 1/2015 | Kimura | |
| 2015/0093138 | A1* | 4/2015 | Tashiro | G03G 15/0863 399/90 |
| 2016/0062293 | A1 | 3/2016 | Nakamura et al. | |
| 2018/0072064 | A1 | 3/2018 | Kiyohara | |
| 2018/0267428 | A1* | 9/2018 | Kawajiri | G03G 15/553 |
| 2022/0365470 | A1* | 11/2022 | Hinoue | G03G 21/18 |

FOREIGN PATENT DOCUMENTS

| | | | |
|---|---|---|---|
| JP | 2000-267421 | A | 9/2000 |
| JP | 2001-297237 | A | 10/2001 |
| JP | 2002-56126 | A | 2/2002 |
| JP | 2002-132922 | A | 5/2002 |
| JP | 2002-149019 | A | 5/2002 |
| JP | 2002-278379 | A | 9/2002 |
| JP | 2002-279095 | A | 9/2002 |
| JP | 2002-287920 | A | 10/2002 |
| JP | 2003-63104 | A | 3/2003 |
| JP | 2003-316555 | A | 11/2003 |
| JP | 2006-292830 | A | 10/2006 |
| JP | 2007-155752 | A | 6/2007 |
| JP | 2007-304160 | A | 11/2007 |
| JP | 2008-271231 | A | 11/2008 |
| JP | 2009-3294 | A | 1/2009 |
| JP | 2011-104825 | A | 6/2011 |
| JP | 2012-22276 | A | 2/2012 |
| JP | 2012-226555 | A | 11/2012 |
| JP | 2013-61880 | A | 4/2013 |
| JP | 2013-190567 | A | 9/2013 |
| JP | 2016-48501 | A | 4/2016 |
| JP | 2016-224156 | A | 12/2016 |
| JP | 2018-39225 | A | 3/2018 |

OTHER PUBLICATIONS

International Search report issued for related PCT/JP2020/031978, dated Nov. 2, 2020.

* cited by examiner

IMAGE FORMING APPARATUS CAPABLE OF DETERMINING WHETHER TO ORDER NEW DRUM CARTRIDGE TOGETHER WITH NEW TONER CARTRIDGE

CROSS REFERENCE TO RELATED APPLICATIONS

This is a by-pass continuation application of International Application No. PCT/JP2020/031978 filed Aug. 25, 2020 claiming priority from Japanese Patent Application No. 2019-158321 filed Aug. 30, 2019. The entire contents of the International Application and the priority application are incorporated herein by reference.

BACKGROUND

There has been conventionally known an order management system automatically orders consumable items for image forming apparatuses and the like. This order management system is connected to a consumable order processing device via a network and automatically orders consumable items through the consumable order processing device so that users do not need to order consumable items.

SUMMARY

However, since a lifespan of a drum cartridge is longer than that of a toner cartridge, a timing for ordering a drum cartridge differs from a timing for ordering a toner cartridge. Consequently, the drum cartridge and the toner cartridge tend to be ordered separately in the conventional system. While it is sometimes preferable to order both the toner cartridge and the drum cartridge at the same time, the conventional system cannot order the toner cartridge and the drum cartridge together.

In view of the foregoing, it is an object of the present disclosure to provide a technique for ordering a toner cartridge and a drum cartridge at the same time in accordance with remaining lives of the toner cartridge and the drum cartridge.

In order to attain the above and other objects, according to one aspect, the present disclosure provides an image forming apparatus including: a main body; a drum cartridge attachable to the main body; a toner cartridge attachable to the main body; a main memory; and a controller. The drum cartridge includes a photosensitive drum. The toner cartridge includes a casing for accommodating toner therein. When image formation is performed, the controller is configured to perform: counting at least one of a cumulative dot count and a first cumulative printed sheet number, the cumulative dot count being indicative of a cumulative number of dots formed in the image formation using the toner cartridge attached to the main body, the first cumulative printed sheet number being indicative of a cumulative number of sheets printed in the image formation using the toner cartridge attached to the main body; counting a second cumulative printed sheet number indicative of a cumulative number of sheets printed in image formation using the drum cartridge attached to the main body; and storing into the main memory at least one of the cumulative dot count and the first cumulative printed sheet number, and the second cumulative printed sheet number. The controller is configured to perform: a first process for determining a first printable sheet number on a basis of the at least one of the cumulative dot count and the first cumulative printed sheet number, the first printable sheet number being indicative of a number of sheets printable using the toner cartridge attached to the main body; a second process for determining a second printable sheet number on a basis of the second cumulative printed sheet number, the second printable sheet number being indicative of a number of sheets printable using the drum cartridge attached to the main body; a third process for determining a third printable sheet number indicative of a number of sheets printable using a new toner cartridge; and when determining that a sum of the first printable sheet number and the third printable sheet number is greater than or equal to the second printable sheet number, a fourth process for transmitting to a server a signal for ordering a new drum cartridge together with a new toner cartridge.

With this configuration, both a new toner cartridge and a new drum cartridge can be ordered together in accordance with remaining lives of the toner cartridge and the drum cartridge.

According to another aspect, the present disclosure also provides a server configured to communicate with an image forming apparatus. The image forming apparatus includes a main body to which a toner cartridge and a drum cartridge are attachable. The server is configured to perform: receiving, from the image forming apparatus, at least one of a cumulative dot count and a first cumulative printed sheet number, the cumulative dot count being indicative of a cumulative number of dots formed in image formation using the toner cartridge attached to the main body, the first cumulative printed sheet number being indicative of a cumulative number of sheets printed in the image formation using the toner cartridge attached to the main body; receiving, from the image forming apparatus, a second cumulative printed sheet number indicative of a cumulative number of sheets printed in image formation using the drum cartridge attached to the main body; determining a first printable sheet number on a basis of the at least one of the cumulative dot count and the first cumulative printed sheet number, the first printable sheet number being indicative of a number of sheets printable using the toner cartridge attached to the main body; determining a second printable sheet number on a basis of the second cumulative printed sheet number, the second printable sheet number being indicative of a number of sheets printable using the drum cartridge attached to the main body; determining a third printable sheet number indicative of a number of sheets printable using a new toner cartridge; when determining that a sum of the first printable sheet number and the third printable sheet number is smaller than the second printable sheet number, ordering a new toner cartridge; and when determining that the sum of the first printable sheet number and the third printable sheet number is greater than or equal to the second printable sheet number, ordering a new drum cartridge together with a new toner cartridge.

With this configuration, the server can order both a new toner cartridge and a new drum cartridge together in accordance with remaining lives of the toner cartridge and the drum cartridge.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Hereinafter, a first embodiment of the present disclosure will be described with reference to FIGS. 1 to 6.

Figure 1:
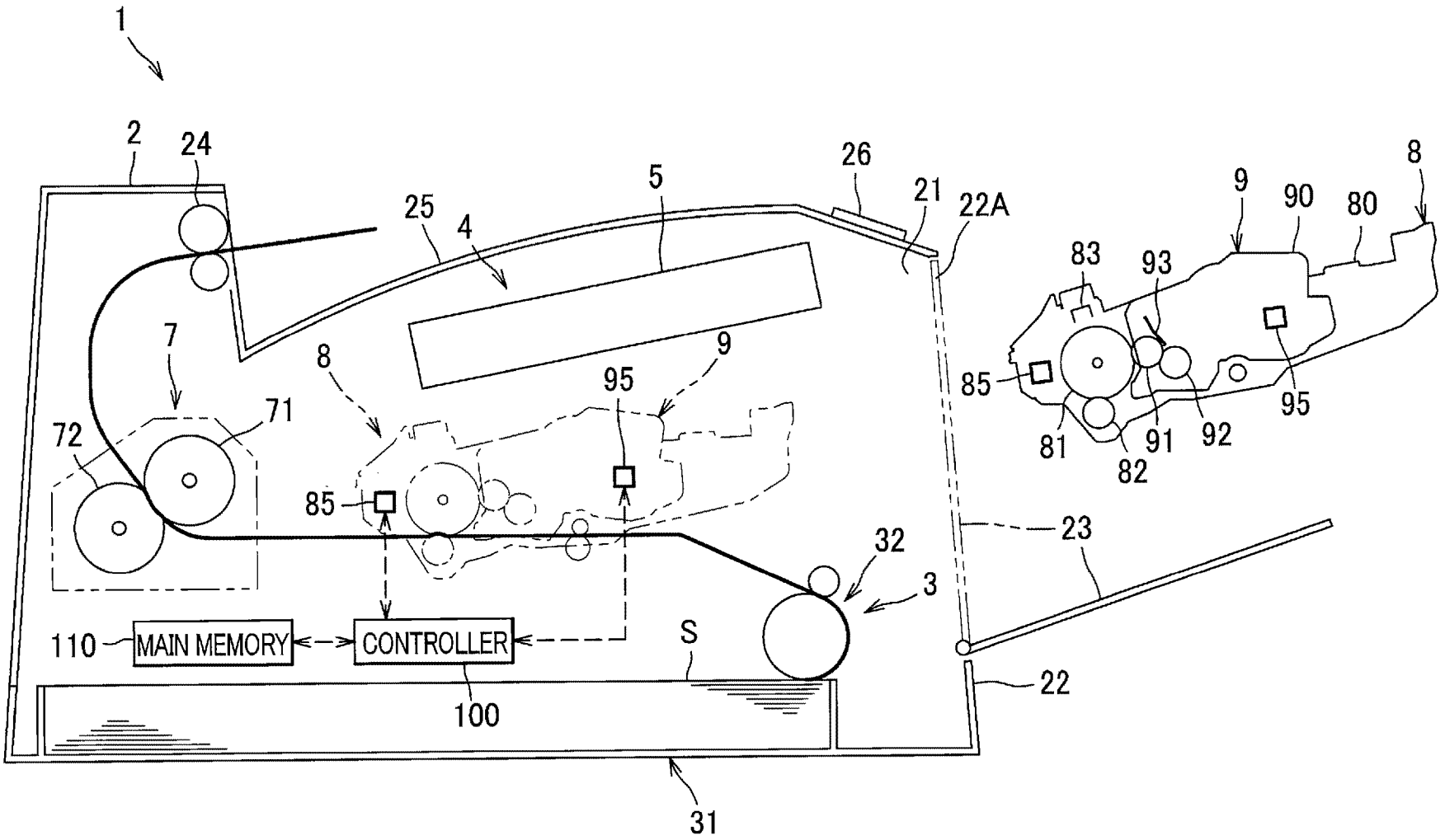
FIG. 1 is a cross-sectional view of an image forming apparatus.

An image forming apparatus 1 is a monochromatic laser printer as illustrated in FIG. 1. The image forming apparatus 1 includes a main body 2, a feeder part 3, an image forming part 4, a controller 100, a main memory 110, and a display 26.

The main body 2 is in a form of a hollow case. The main body 2 includes a pair of side walls 21, and a front wall 22 connecting the side walls 21 to each other. The front wall 22 has a main opening 22A. A cover 23 for opening and closing the main opening 22A is provided at the front wall 22. The cover 23 is configured to be opened and closed when replacing a consumable item.

The feeder part 3 includes a supply tray 31, and a supply mechanism 32. The supply tray 31 is attached to a lower portion of the main body 2 so as to be detachable therefrom. The supply mechanism 32 is configured to supply a sheet(s) in the supply tray 31 toward the image forming part 4.

The image forming part 4 includes a scanner unit 5, a fixing device 7, a drum cartridge 8, and a toner cartridge 9.

The scanner unit 5 is provided at an upper portion inside the main body 2, and includes a laser emitting part, a polygon mirror, lenses, and a reflection mirror those are not illustrated in the drawings. The scanner unit 5 is configured to irradiate a surface of a photosensitive drum 81 (described later) with laser beam by way of high-speed scanning.

The controller 100 is, for example, a CPU. As described above, the image forming apparatus 1 includes the main memory 110. The main memory 110 includes, for example, a RAM and an EEPROM. The controller 100 executes an arithmetic operation based on information about the attached cartridge and programs/data stored in the RAM and an ROM, thereby performing a print control. The CPU is electrically connected to the RAM, the ROM, the EEPRAM, a drum memory 85, and a toner memory 95 (the latter two will be described later).

The display 26 is positioned at an outer surface of the main body 2. The display 26 displays various kinds of messages thereon based on instructions received from the controller 100.

The drum cartridge 8 is positioned between the feeder part 3 and the scanner unit 5. The drum cartridge 8 is attachable to the main body 2. Specifically, the drum cartridge 8 is attachable to and detachable from the main body 2 through the main opening 22A opened and closed by the cover 23 of the main body 2.

Figure 2:
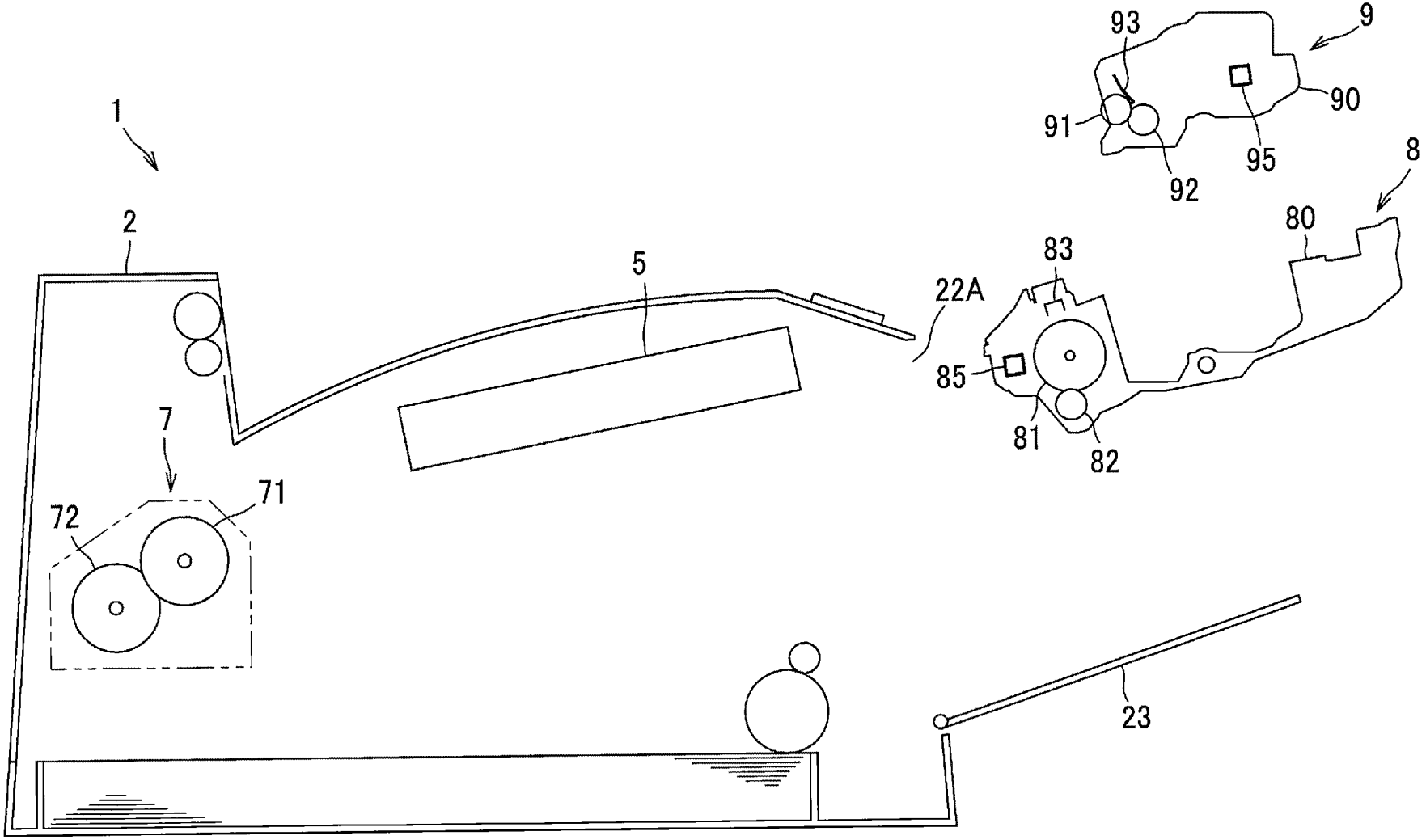
FIG. 2 is a view illustrating a state where a toner cartridge and a drum cartridge are detached from a main body of the image forming apparatus.

As illustrated in FIG. 2, the toner cartridge 9 is attachable to the main body 2. In the present embodiment, the toner cartridge 9 is attachable to and detachable from the drum cartridge 8. That is, the toner cartridge 9 is attachable to the main body 2 while the toner cartridge 9 is are assembled to the drum cartridge 8.

Referring back to FIG. 1, the drum cartridge 8 includes a frame 80 to which the toner cartridge 9 is attachable, the photosensitive drum 81, a transfer roller 82, a charger 83, and the drum memory 85. Both the photosensitive drum 81 and the transfer roller 82 are rotatably supported by the frame 80.

The drum memory 85 is a medium that stores therein information and is, for example, an IC chip. Note that the drum memory 85 need not be limited to an IC chip.

The toner cartridge 9 includes a casing 90, a developing roller 91, a supply roller 92, a blade 93, and the toner memory 95. The casing 90 is configured to accommodate toner therein. The developing roller 91 supplies toner onto the photosensitive drum. The supply roller 92 supplies the toner accommodated in the casing 90 to the developing roller 91. The blade 93 regulates a layer thickness of the toner supplied to the developing roller 91.

The toner memory 95 is a medium that stores information therein. The toner memory 95 is, for example, an IC chip, but need not be limited to an IC chip.

In this drum cartridge 8, a surface of the rotating photosensitive drum 81 is uniformly charged by the charger 83. Thereafter, the surface of the photosensitive drum 81 is partially exposed to a high-speed scanning laser beam emitted from the scanner unit 5, thereby causing an electrical potential in the exposed portion to lower and forming an electrostatic latent image on the surface of the photosensitive drum 81 based on image data.

Next, the rotating developing roller 91 supplies the toner accommodated in the toner cartridge 9 to the photosensitive drum 81, whereby a toner image is formed on the surface of the photosensitive drum 81. Thereafter, the toner image carried on the surface of the photosensitive drum 81 is transferred onto the sheet S conveyed to a portion between the photosensitive drum 81 and the transfer roller 82.

The fixing device 7 includes a heat roller 71 and a pressure roller 72. The pressure roller 72 faces and presses the heat roller 71. The fixing device 7 thermally fixes the toner transferred to the sheet S while the sheet S passes through a portion between the heat roller 71 and the pressure roller 72.

The sheet S on which toner is thermally fixed by the fixing device 7 is conveyed toward discharge rollers 24 positioned downstream of the fixing device 7 and then discharged out onto a discharge tray 25 through the discharge rollers 24.

Figure 3:
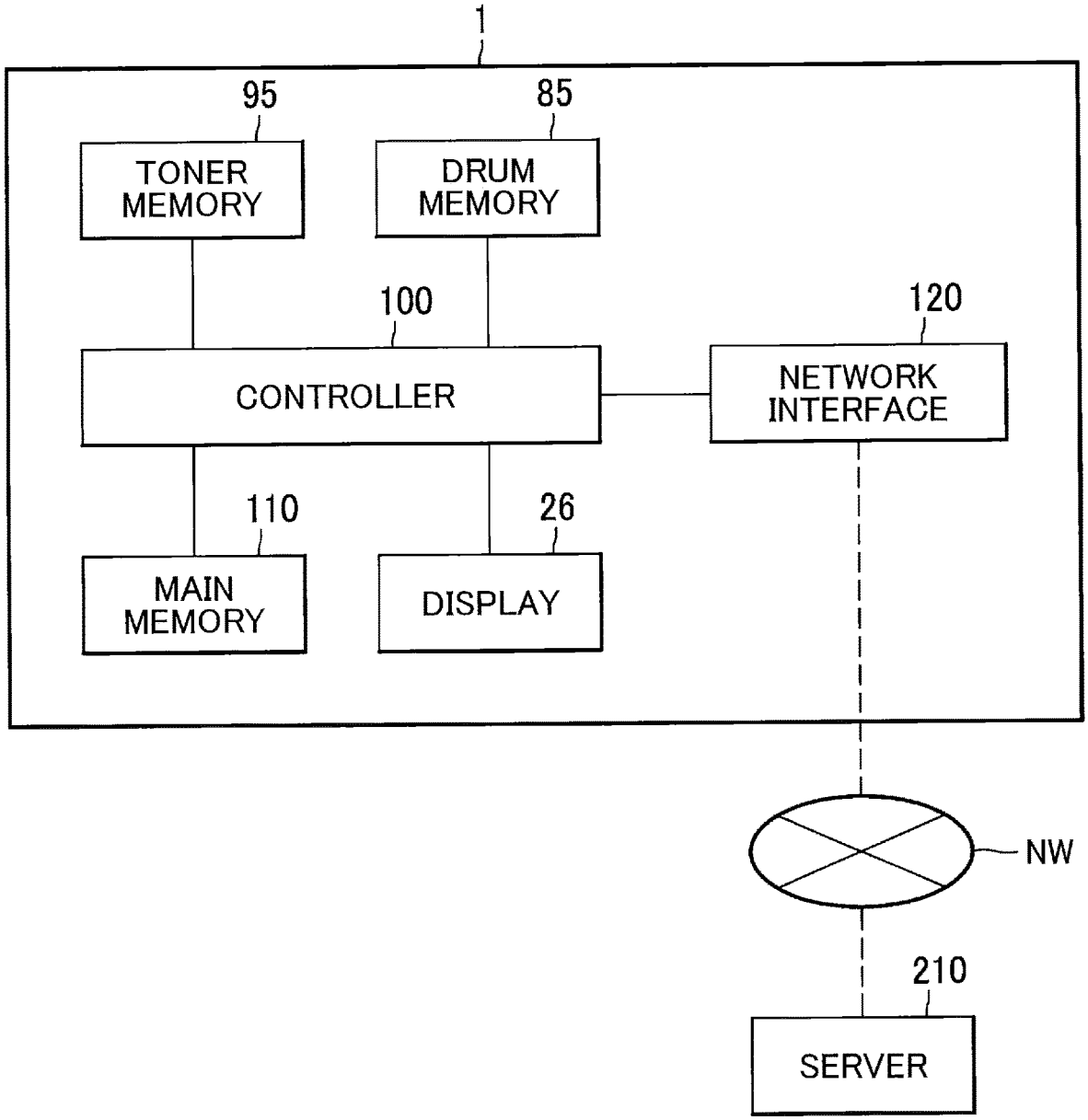
FIG. 3 is a block diagram illustrating a system.

As illustrated in FIG. 3, the image forming apparatus 1 is configured to communicate with a server 210. Specifically, the image forming apparatus 1 further includes a network interface 120 that enables the image forming apparatus 1 to communicate with the server 210 via a network NW. The network interface 120 is configured of a circuit board, chips, and the like for connection to a wired LAN or a wireless LAN, for example.

The server 210 is a server that is configured to receive orders for the toner cartridge 9 and the drum cartridge 8 issued from the controller 100. In other words, the server 210 is configured to execute an order receiving process for receiving orders for the drum cartridge 8 and the toner cartridge 9 from the controller 100.

Next, processes performed by the controller 100 will be described. When the image forming apparatus 1 forms images on sheets S, the controller 100 counts at least one of a cumulative dot count RT1 and a cumulative printed sheet number CT1 as an example of a first cumulative printed sheet number together with a cumulative rotation number NT1 of the developing roller 91 for a first toner cartridge, and stores these counts into the main memory 110.

The cumulative dot count RT1 is indicative of the cumulative number of dots formed in image formation using the first toner cartridge. The cumulative printed sheet number CT1 is indicative of the cumulative number of sheets in the image formation using the first toner cartridge. The cumulative rotation number NT1 is indicative of the cumulative number of rotations of the developing roller 91 in the image formation using the first toner cartridge.

When the image forming apparatus 1 forms images on sheets S, the controller 100 also counts each of a cumulative printed sheet number CD1 as an example of a second cumulative printed sheet number, and a cumulative rotation number ND1 of the photosensitive drum 81 for a first drum cartridge, and stores these counts in the main memory 110. The cumulative printed sheet number CD1 is indicative of the cumulative number of sheets printed in image formation using the first drum cartridge. The cumulative rotation number ND1 is indicative of the cumulative number of rotations of the photosensitive drum 81 in the image formation using the first drum cartridge.

The controller 100 also stores in the main memory 110 a cumulative dot count RT3 in a prescribed period of time, a cumulative printed sheet number CT3 in the prescribed period of time, a cumulative rotation number NT3 of the developing roller 91 in the prescribed period of time, and a cumulative rotation number ND3 of the photosensitive drum 81 in the prescribed period of time.

The prescribed period of time may be set to a period of time that the attached toner cartridge 9 is used, a period of time that the image forming apparatus 1 is used, or any predetermined period such as six months. In the present embodiment, the prescribed period of time will be the period of time that the image forming apparatus 1 is used.

Each of the toner cartridge 9 and the drum cartridge 8 has a plurality of specifications related to a service life, a destination, a quality, and the like. For the toner cartridge 9, a standard print sheet number and a standard per-sheet dot count are preset according to these specifications. For the drum cartridge 8, a standard print sheet number and a standard per-sheet rotation number of the photosensitive drum 81 are preset according to the specifications. The standard print sheet number of the toner cartridge 9 and the standard per-sheet dot count are stored in the toner memory 95, while the standard print sheet number of the drum cartridge 8 and the standard per-sheet rotation number of the photosensitive drum 81 are stored in the drum memory 85.

In the present disclosure, the toner cartridge 9 attached to the main body 2 is also referred to as "first toner cartridge", while a new toner cartridge 9 to be attached to the main body 2 subsequent to the first toner cartridge is also referred to as "second toner cartridge". Similarly, the drum cartridge 8 attached to the main body 2 is also referred to as "first drum cartridge," while a new drum cartridge 8 to be attached to the main body 2 subsequent to the first drum cartridge is also referred to as "second drum cartridge."

In the following description, a state of the toner cartridge 9 when the toner cartridge 9 is empty (i.e., a remaining quantity of toner is near 0%) and the toner cartridge 9 reaches an end of service life will be referred to as "toner empty." A state of the toner cartridge 9 when toner in the toner cartridge 9 becomes low and the toner cartridge 9 approaches the end of service life will be referred to as "toner low." In the present embodiment, the toner cartridge 9 becomes the toner low state when the remaining quantity of toner in the casing 90 becomes less than or equal to a first threshold value. The first threshold value in the present embodiment is set to a remaining quantity of 10%.

The controller 100 determines the remaining quantity of toner in the casing 90 based on the cumulative dot count RT1, and stores the determined remaining quantity of toner into the main memory 110. When the remaining quantity of toner in the casing 90 is determined to be less than or equal to the first threshold value, the controller 100 performs first, second, third, and fourth processes described below.

The first process is performed for determining a printable sheet number LT1 for the first toner cartridge based on the at least one of the cumulative dot count RT1 indicative of the cumulative number of dots formed during image formation using the first toner cartridge attached to the main body 2, and the cumulative printed sheet number CT1 indicative of the cumulative number of sheets printed during the image formation using the first toner cartridge. The printable sheet number LT1 is an example of a first printable sheet number.

Since the first toner cartridge includes the developing roller 91 in the present embodiment, the printable sheet number LT1 is determined in the first process based on at least one of the cumulative dot count RT1, the cumulative printed sheet number CT1, and the cumulative rotation number NT1 indicative of the cumulative number of rotations of the developing roller 91.

Specifically, the controller 100 multiplies the standard print sheet number for the first toner cartridge by the standard per-sheet dot count and the cumulative printed sheet number CT3 in the prescribed period of time, and divides the product by the cumulative dot count RT3 in the prescribed period of time to obtain a value P1.

$$P1=(\text{the standard print sheet number for the first toner cartridge})\times(\text{the standard per-sheet dot count})\times CT3/RT3$$

Next, the controller 100 multiplies the standard print sheet number for the first toner cartridge by the standard per-sheet rotation number of the developing roller and the cumulative printed sheet number CT3 in the prescribed period of time, and divides the product by the cumulative rotation number NT3 of the developing roller in the prescribed period of time to obtain a value P2.

$$P2=(\text{the standard print sheet number for the first toner cartridge})\times(\text{the standard per-sheet rotation number of the developing roller})\times CT3/NT3$$

Next, the controller 100 calculates the printable sheet number LT1 for the first toner cartridge by subtracting the cumulative printed sheet number CT1 for the first toner cartridge from of the value P1 or the value P2 whichever is smaller.

$$LT1=(\text{the smaller of } P1 \text{ and } P2)-CT1$$

The second process is performed for determining a printable sheet number LD1 for the first drum cartridge based on the cumulative printed sheet number CD1 indicative of the cumulative number of sheets printed during image formation using the first drum cartridge attached to the main body 2. The printable sheet number LD1 is an example of a second printable sheet number.

Specifically, the controller 100 multiplies the standard print sheet number for the first drum cartridge by the standard per-sheet rotation number of the photosensitive drum and the cumulative printed sheet number CT3 in the prescribed period of time, and divides the product by the cumulative rotation number ND3 of the photosensitive drum in the prescribed period of time to obtain a value P3.

$$P3=(\text{the standard print sheet number for the first drum cartridge})\times(\text{the standard per-sheet rotation number of the photosensitive drum})\times CT3/ND3$$

Next, the controller 100 calculates the printable sheet number LD1 for the first drum cartridge by subtracting the cumulative printed sheet number CD1 from the value P3 or a standard print sheet number P4 indicative of the standard print sheet number of the drum cartridge, whichever is smaller.

$$LD1=(\text{the smaller of } P3 \text{ and } P4)-CD1$$

The third process is performed for determining a printable sheet number LT2 for the second toner cartridge. The printable sheet number LT2 is an example of a third printable sheet number.

Specifically, the controller 100 multiplies the standard print sheet number for the second toner cartridge by the standard per-sheet dot count and the cumulative printed sheet number CT3 in the prescribed period of time, and divides the product by the cumulative dot count RT3 in the prescribed period of time to obtain a value P5.

$$P5=(\text{the standard print sheet number for the second toner cartridge})\times(\text{the standard per-sheet dot count})\times CT3/RT3$$

The controller 100 also multiplies the standard print sheet number for the second toner cartridge by the standard per-sheet rotation number of the developing roller and the cumulative printed sheet number CT3 in the prescribed period of time, and divides the product by the cumulative rotation number NT3 of the developing roller in the prescribed period of time to obtain a value P6.

$$P6=(\text{the standard print sheet number for the second toner cartridge})\times(\text{the standard per-sheet rotation number of the developing roller})\times CT3/NT3$$

The controller 100 determines the values P5 or the value P6 whichever is smaller to the printable sheet number LT2 for the second toner cartridge. Note that the standard print sheet number for the second toner cartridge may be the same as or different from the standard print sheet number for the first toner cartridge.

In the fourth process, the controller 100 determines whether the sum of the printable sheet number LT1 for the first toner cartridge and the printable sheet number LT2 for the second toner cartridge is greater than or equal to the printable sheet number LD1 for the first drum cartridge (i.e., whether an inequality LT1+LT2≥LD1 is satisfied).

Figure 4A:
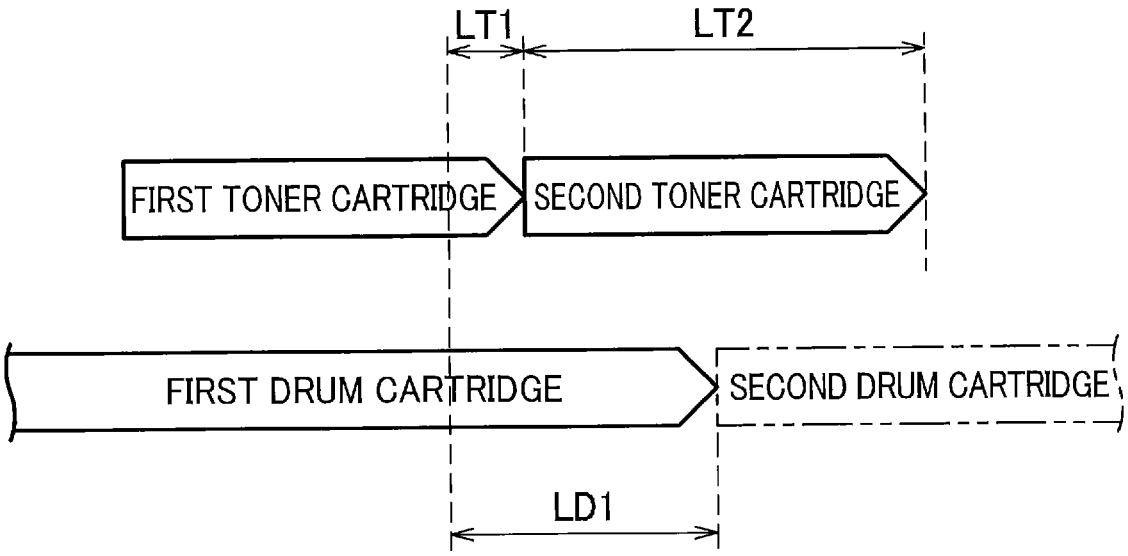
FIG. 4A is a diagram illustrating a case where an inequality LT1+LT2≥LD1 is satisfied.

When the controller 100 determines that the sum of the printable sheet number LT1 and the printable sheet number LT2 is greater than or equal to the printable sheet number LD1 (i.e., that the inequality LT1+LT2≥LD1 is satisfied) as illustrated in FIG. 4A, the controller 100 transmits a signal to the server 210 to order both a second toner cartridge and a second drum cartridge.

Figure 4B:
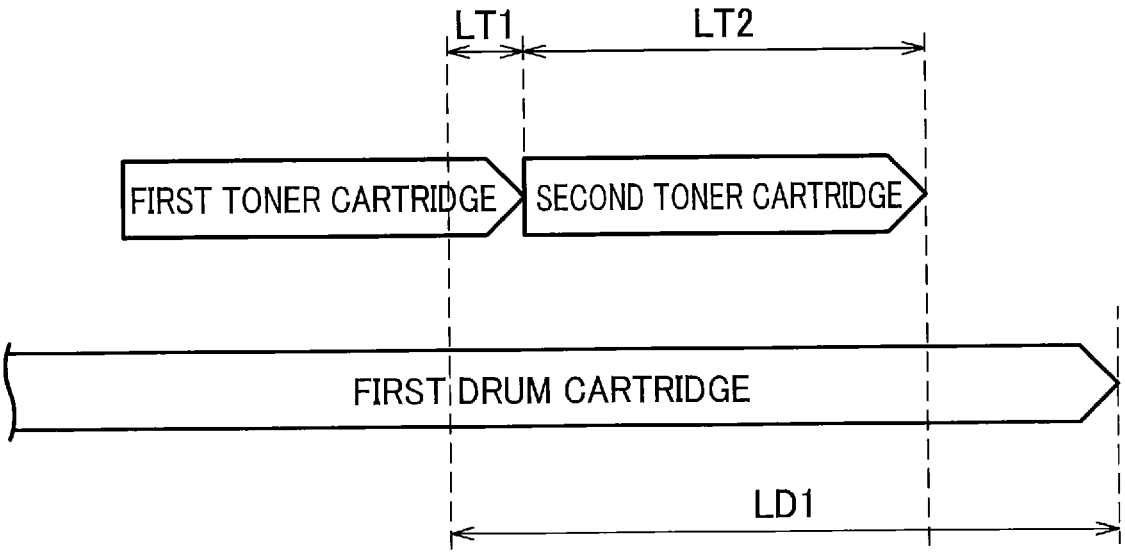
FIG. 4B is a view illustrating a case where the inequality LT1+LT2≥LD1 is not satisfied.

On the other hand, when the controller 100 determines that the sum of the printable sheet number LT1 and the printable sheet number LT2 is less than the printable sheet number LD1 (i.e., that the inequality LT1+LT2≥LD1 is not satisfied) as illustrated in FIG. 4B, the controller 100 transmits a signal to the server 210 to order a second toner cartridge. In this case, the controller 100 only orders a second toner cartridge but does not order a second drum cartridge.

Figure 5A:
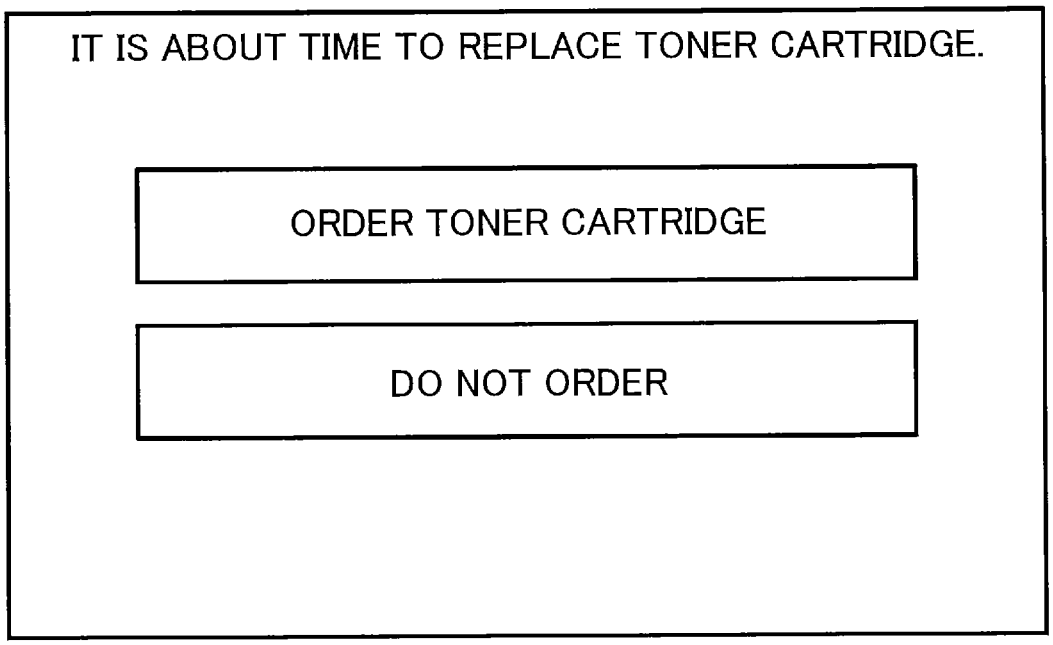
FIG. 5A illustrates a confirmation screen for ordering a new toner cartridge.

In the present embodiment, the controller 100 displays a message on the display 26 prior to transmitting a signal to the server 210 for ordering cartridge(s). The message is displayed to confirm the order with the user. Specifically, when the inequality LT1+LT2≥LD1 is not satisfied, the controller 100 displays on the display 26 a selection screen including options "ORDER TONER CARTRIDGE" and "DO NOT ORDER" as illustrated in FIG. 5A.

Figure 5B:
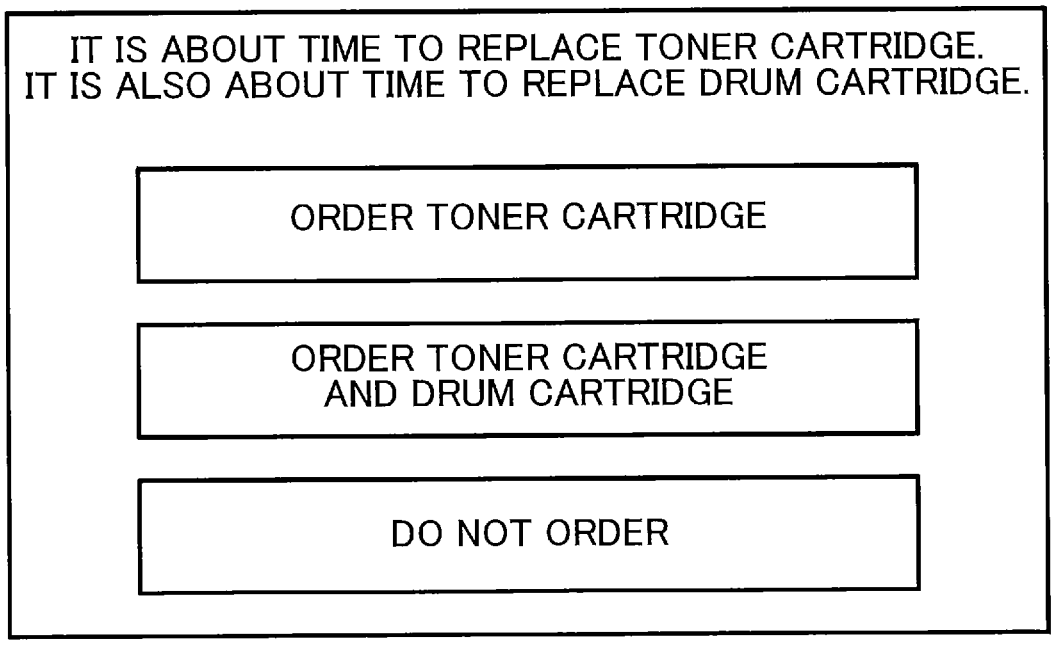
FIG. 5B illustrates a selection screen for ordering a new toner cartridge and a new drum cartridge.

On the other hand, when the inequality LT1+LT2≥LD1 is satisfied, the controller 100 displays a selection screen that illustrated in FIG. 5B on the display 26. This selection screen includes options "ORDER TONER CARTRIDGE", "ORDER TONER CARTRIDGE AND DRUM CARTRIDGE", and "DO NOT ORDER".

Once the user selects one of the options in the selection screen displayed on the display 26, the controller 100 transmits a signal to the server 210 to order the selected cartridge(s).

Next, one example of processes executed by the controller 100 will be described with reference to a flowchart of FIG. 6. The controller 100 repeatedly executes the processes described below while the image forming apparatus 1 performs image formation.

Figure 6:
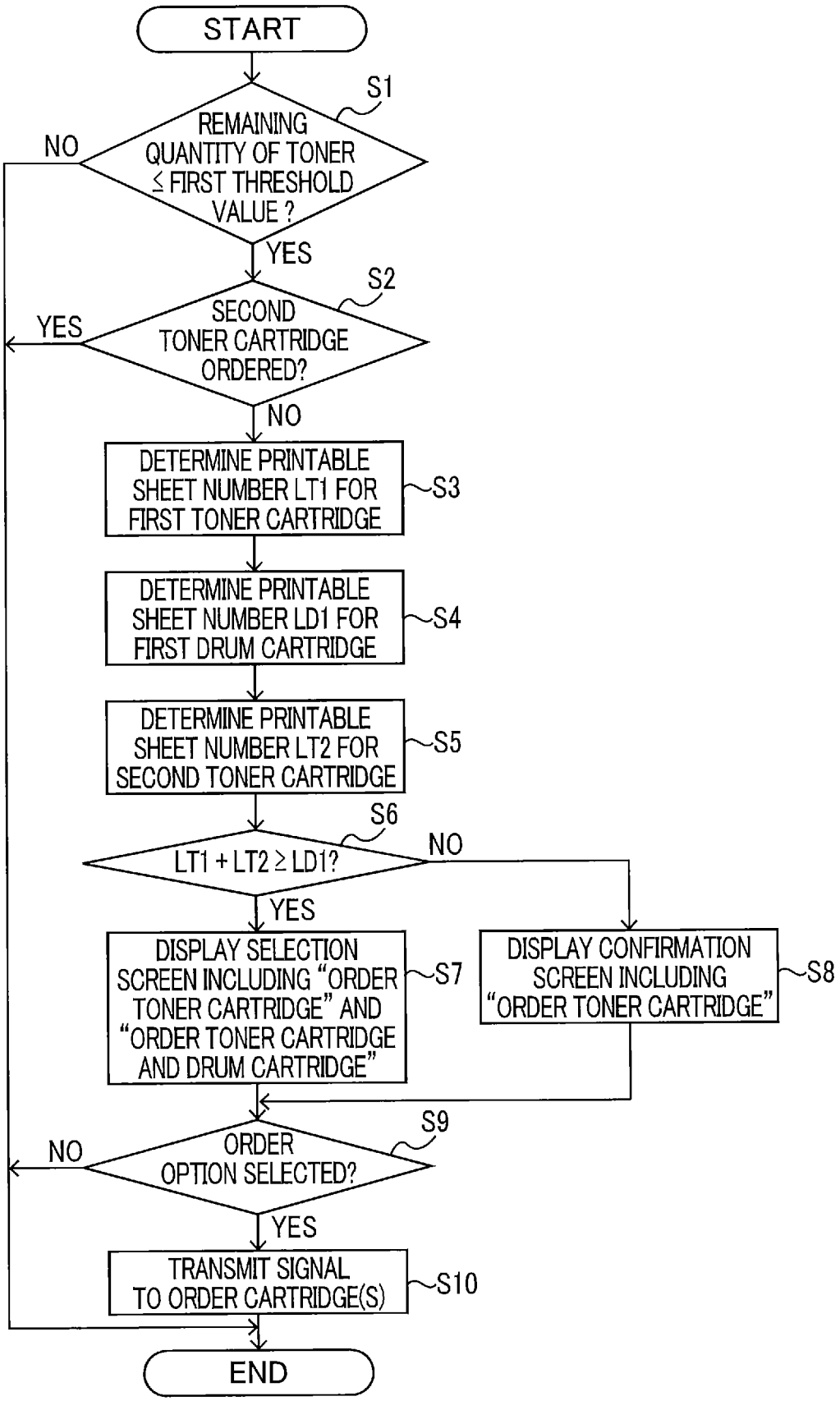
FIG. 6 is a flowchart illustrating one example of steps in a process executed by a controller.

In S1 of FIG. 6, the controller 100 determines whether the remaining quantity of toner in the toner cartridge 9 is less than or equal to the first threshold value.

When the controller 100 determines in S1 that the remaining quantity of toner in the toner cartridge 9 is greater than the first threshold value (S1: NO), the controller 100 ends the process in FIG. 6. In this case, there is no need to order a second toner cartridge since the toner cartridge 9 is not in the toner low state.

On the other hand, when the controller 100 determines in S1 that the remaining quantity of toner in the toner cartridge 9 is less than or equal to the first threshold value (S1: YES), in S2 the controller 100 determines whether a second toner cartridge is already ordered.

When the controller 100 determines in S2 that a second toner cartridge is already ordered (S2: YES), the controller 100 ends the process of FIG. 6 since there is no need to order a second toner cartridge.

On the other hand, when the controller 100 determines in S2 that a second toner cartridge is not yet ordered (S2: NO), in S3 the controller 100 determines the printable sheet number LT1 for the first toner cartridge, in S4 determines the printable sheet number LD1 for the first drum cartridge, and in S5 determines the printable sheet number LT2 for the second toner cartridge.

Subsequent to the process of S5, in S6 the controller 100 determines whether the inequality LT1+LT2≥LD1 is satisfied.

When the controller 100 determines in S6 that the inequality LT1+LT2≥LD1 is satisfied (S6: YES), in S7 the controller 100 displays a selection screen on the display 26 (see the example of FIG. 5B) with the options to order a toner cartridge or to order both a toner cartridge and a drum cartridge.

On the other hand, when the controller 100 determines in S6 that the inequality LT1+LT2≥LD1 is not satisfied (S6: NO), in S8 the controller 100 displays a confirmation screen on the display 26 (see FIG. 5A) to confirm whether or not a toner cartridge should be ordered.

After performing one of the processes in S7 and S8, in S9 the controller 100 determines whether an option to order a cartridge(s) is selected in S7 or S8.

When the controller 100 determines in S9 that an option to order a cartridge(s) is not selected (S9: NO), the controller 100 ends the process in FIG. 6. On the other hand, when an option to order a cartridge(s) is selected (S9: YES), in S10 the controller 100 transmits a signal to the server 210 to order the selected cartridge(s).

The image forming apparatus 1 according to the present embodiment described above can obtain the following technical advantages.

The controller 100 in the image forming apparatus 1 orders both a second toner cartridge and a second drum cartridge when the inequality LT1+LT2≥LD1 is satisfied, as in the example of FIG. 4A. However, when the inequality LT1+LT2≥LD1 is not satisfied as in the example of FIG. 4B, the controller 100 orders only a second toner cartridge and not a second drum cartridge.

Thus, when ordering a second drum cartridge as in the example of FIG. 4A, the second drum cartridge can be ordered together with a second toner cartridge. Since a toner cartridge and a drum cartridge can be shipped together in one package, there is a high probability that shipping costs can be lowered. Note that a second drum cartridge need not be ordered at the same time as a second toner cartridge, but ordering of a second toner cartridge may trigger order of a second drum cartridge.

Further, the controller 100 calculates the printable sheet number LT1 of the first toner cartridge by subtracting the cumulative printed sheet number CT1 for the first toner cartridge from the values P1 or the value P2 whichever is smaller. The value P1 is calculated based on the cumulative printed sheet number CT3 in the prescribed period of time and the cumulative dot count RT3 in the prescribed period of time, and the value P2 is calculated from the cumulative rotation number NT3 of the developing roller in the prescribed period of time.

In normal usage, a value calculated based on the value P1 can be applied. However, when power to the image forming apparatus 1 is turned on and off more frequently than in the normal usage, for example, the cumulative rotation number NT3 of the developing roller may become relatively large and the value P2 may become relatively small. In such cases, as the controller 100 calculates the printable sheet number LT1 of the first toner cartridge by subtracting the cumulative printed sheet number CT1 for the first toner cartridge from the value P2 corresponding to deterioration of the developing roller 91, a more suitable printable sheet number LT1 for the first toner cartridge can be obtained.

Note that, since the prescribed period of time used as the subject of the cumulative printed sheet number CT3, the cumulative dot count RT3, and the cumulative rotation number NT3 is set to a lengthy period, i.e., the period of time the image forming apparatus 1 is used, a more suitable printable sheet number LT1 for the first toner cartridge can be calculated.

Further, the controller 100 calculates the value P3 based on the cumulative rotation number ND3 of the photosensitive drum in the prescribed period of time, and calculates the printable sheet number LD1 by subtracting the cumulative printed sheet number CD1 for the first drum cartridge from the value P3 or the standard print sheet number P4 for the drum cartridge whichever is smaller.

Although the standard print sheet number P4 for the drum cartridge can be applied in normal usage, the cumulative rotation number ND3 for the photosensitive drum may become relatively large and the value P3 may become relatively small when the power to the image forming apparatus 1 is turned on and off more frequently than in the normal usage, for example. In this case, a more suitable printable sheet number LD1 for the first drum cartridge can be calculated by subtracting the cumulative printed sheet number CD1 for the first drum cartridge from the value P3 corresponding to deterioration of the photosensitive drum 81.

Note that, since the prescribed period of time that is the subject of the cumulative rotation number ND3 of the photosensitive drum 81 is set to a lengthy period equivalent to the period of time that the image forming apparatus 1 is used, a more suitable printable sheet number LD1 for the drum cartridge can be calculated.

Next, a second embodiment of the present disclosure will be described with reference to FIGS. 7 and 8. In the first embodiment described above, the controller 100 of the image forming apparatus 1 executes a determination process to determine whether to order a new drum cartridge and a new toner cartridge together. Processes in the second embodiment are different from those in the first embodiment in that a server executes the determination process to determine whether to order a new drum cartridge together with a new toner cartridge. The following description of the second embodiment omits descriptions of parts similar to those described in the first embodiment.

Figure 7:
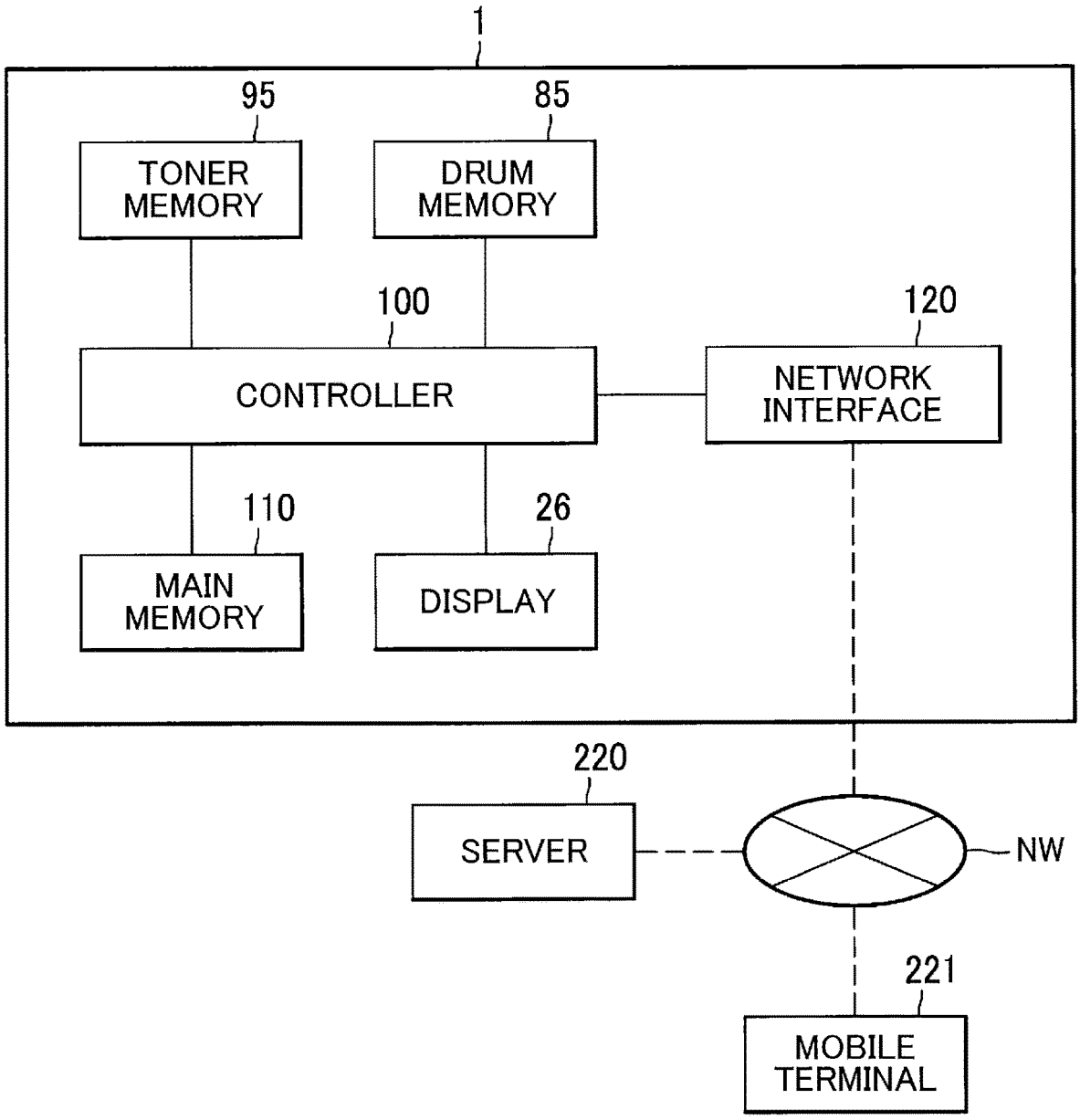
FIG. 7 is a block diagram illustrating a system.
Figure 8:
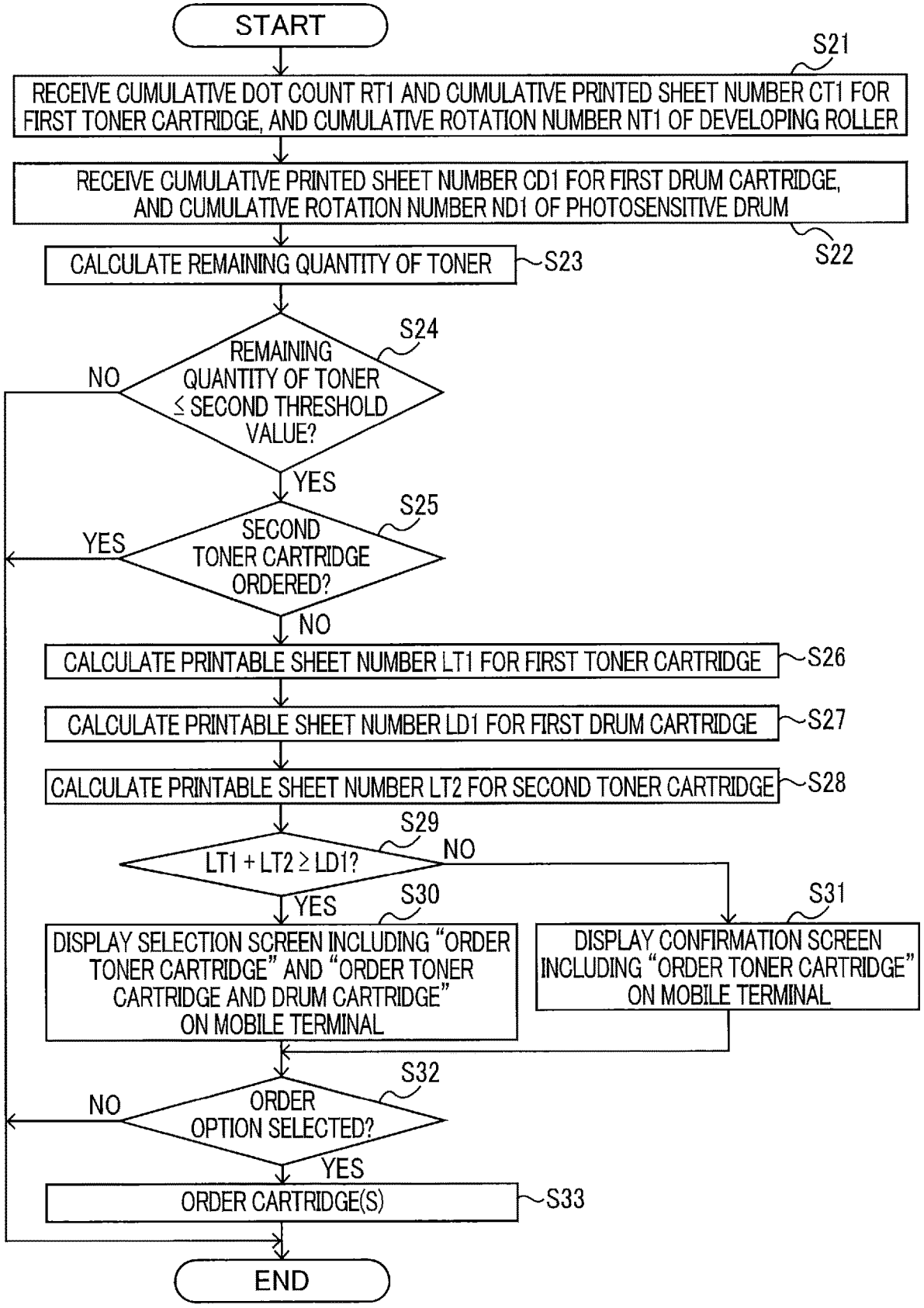
FIG. 8 is a flowchart illustrating one example of steps in a process executed by a server.

As illustrated in FIG. 7, a server 220 can communicate with the image forming apparatus 1 including the main body 2 to which the toner cartridge 9 and the drum cartridge 8 are attachable. The server 220 can also communicate with a mobile terminal 221 belonging to the user.

The server 220 receives at least one of the cumulative dot count RT1 and the cumulative printed sheet number CT1 together with the cumulative printed sheet number CD1 from the image forming apparatus 1. The cumulative dot count RT1 is indicative of the cumulative number of dots formed during image formation using the first toner cartridge, i.e., the toner cartridge 9 attached to the main body 2. The cumulative printed sheet number CT1 is indicative of the cumulative number of sheets printed during the image formation using the first toner cartridge. The cumulative printed sheet number CD1 is indicative of the cumulative number of sheets printed during the image formation using the first drum cartridge, i.e., the drum cartridge 8 attached to the main body 2.

The server 220 determines the printable sheet number LT1 for the first toner cartridge based on at least one of the cumulative dot count RT1 and the cumulative printed sheet number CT1. The server 220 also determines the printable sheet number LD1 for the first drum cartridge based on the cumulative printed sheet number CD1. Subsequently, the server 220 determines the printable sheet number LT2 for the second toner cartridge, i.e., a new toner cartridge 9.

When the controller 100 determines that the sum of the printable sheet number LT1 for the first toner cartridge and the printable sheet number LT2 for the second toner cartridge is less than the printable sheet number LD1 for the first drum cartridge, the server 220 executes a process to order a second toner cartridge.

When the controller 100 determines that the sum of the printable sheet number LT1 for the first toner cartridge and the printable sheet number LT2 for the second toner cartridge is greater than or equal to the printable sheet number LD1 for the first drum cartridge, the server 220 executes a process to order both a second toner cartridge and a new drum cartridge 8, that is, a second drum cartridge. Note that, when the ordering process described here is performed, the server 220 may transmit a request over a network to another server or another terminal that ships products in order to place an order.

Next, one example of processes executed by the server 220 according to the second embodiment will be described with reference to a flowchart in FIG. 8.

In S21, the server 220 receives at least one of the cumulative dot count RT1 and the cumulative printed sheet number CT1, and the cumulative rotation number NT1 of the developing roller for the first toner cartridge from the controller 100 of the image forming apparatus 1.

Subsequently, in S22 the server 220 receives the cumulative printed sheet number CD1 and the cumulative rotation number ND1 of the photosensitive drum for the first drum cartridge from the controller 100 of the image forming apparatus 1.

After the process of S22, in S23 the server 220 calculates the remaining quantity of toner in the first toner cartridge from the cumulative dot count RT1 for the first toner cartridge.

In S24 the server 220 determines whether the remaining quantity of toner in the first toner cartridge is less than or equal to a second threshold value.

When the server 220 determines in S24 that the remaining quantity of toner is greater than the second threshold value (S24: NO), the server 220 ends the process of FIG. 8. In this case, the first toner cartridge is not in the toner low state and, hence, there is no need to order a second toner cartridge.

However, when the server 220 determines in S24 that the remaining quantity of toner in the first toner cartridge is less than or equal to the second threshold value (S24: YES), in S25 the server 220 determines whether a second toner cartridge is already ordered.

When the server 220 determines in S25 that a second toner cartridge is already ordered (S25: YES), the server 220 ends the process in FIG. 8 since there is no need to order another second toner cartridge.

However, when the server 220 determines in S25 that a second toner cartridge is not yet ordered (S25: NO), in S26 the server 220 calculates the printable sheet number LT1 for the first toner cartridge, in S27 calculates the printable sheet number LD1 for the first drum cartridge, and in S28 calculates the printable sheet number LT2 for the second toner cartridge. The methods of calculating the printable sheet number LT1, the printable sheet number LD1, and the printable sheet number LT2 are identical to those described in the first embodiment and, hence, a description will not be repeated here.

After completing the process of S28, in S29 the server 220 determines whether the inequality LT1+LT2≥LD1 is satisfied.

When the server 220 determines in S29 that the inequality LT1+LT2≥LD1 is satisfied (S29: YES), in S30 the server 220 displays a selection screen (see FIG. 5B) on the mobile terminal 221 indicating options to order one of a second toner cartridge alone, and both a second toner cartridge and a second drum cartridge.

On the other hand, when the server 220 determines in S29 that the inequality LT1+LT2≥LD1 is not satisfied (S29: NO), in S31 the server 220 displays a confirmation screen (see FIG. 5A) on the mobile terminal 221 for confirming whether to order a second toner cartridge.

After completing one of the display processes in S30 and S31, in S32 the server 220 determines whether an option to order a cartridge(s) is selected in S30 or S31.

When the server 220 determines in S32 that an option to order a cartridge(s) is not selected (S32: NO), the server 220 ends the process in FIG. 8. On the other hand, when the server 220 determines in S32 that an option to order a cartridge(s) is selected (S32: YES), in S33 the server 220 executes a process to order the selected cartridge(s).

According to the server 220 in the second embodiment described above, when ordering a second drum cartridge, the server 220 can order a second drum cartridge together with a second toner cartridge. Accordingly, there is a high probability that shipping costs can be reduced since a toner cartridge and a drum cartridge can be shipped in a single package, for example.

While the description has been made in detail with reference to the embodiments, it would be apparent to those skilled in the art that the present disclosure is not limited to the above-described embodiments and many modifications may be made thereto, as will be described below.

In the above-described embodiment, an order is finalized by displaying an order confirmation screen on the display 26 and prompting the user to select an option to order. However, the image forming apparatus 1 may be configured to automatically issue an order to the server 210 without prompting the user for confirmation.

In the above-described embodiments, the toner cartridge includes a developing roller. However, the cartridges may be configured such that the drum cartridge includes a developing roller and the toner cartridge does not. Since the toner cartridge does not include a developing roller in this case, the controller 100 calculates the printable sheet number LT1 for the first toner cartridge in the first process by subtracting the cumulative printed sheet number CT1 for the first toner cartridge from the value P1 (LT1=P1−CT1).

Further, since the drum cartridge includes a developing roller, the controller 100 calculates the printable sheet number LD1 for the first drum cartridge in the second process by subtracting the cumulative printed sheet number CD1 for the first drum cartridge from the smallest value among the standard print sheet number P4 for the drum cartridge, the value P2, and the value P3.

$$LD1=(\text{the smallest of } P2, P3, \text{ and } P4)-CD1$$

In order to determine whether the remaining quantity of toner in the casing 90 is less than or equal to the first threshold value in the embodiment described above, the controller 100 calculates the remaining quantity of toner based on the cumulative dot count RT1 or the cumulative printed sheet number CT1. However, the remaining quantity of toner in the casing 90 may be measured using a photosensor or a weight scale, for example.

In the above-described embodiments, the toner cartridge is attachable to the main body while the toner cartridge is attached to the drum cartridge. However, the toner cartridge may be attachable directly to the main body. In this case, the toner cartridge and the drum cartridge are attachable to the main body independently from each other.

Although the above-described embodiments describe a monochromatic laser printer as an example of an image forming apparatus, the image forming apparatus may be a color laser printer, a copying machine, or a multifunction peripheral. Note that, when the present disclosure is applied to a color laser printer, the processes described above are repeated for the toner cartridge and the drum cartridge for each color.

The elements appearing in the embodiments and modifications described above may be appropriately combined and implemented.

What is claimed is:

1. An image forming apparatus comprising:

a main body;

a drum cartridge attachable to the main body, the drum cartridge including a photosensitive drum;

a toner cartridge attachable to the main body, the toner cartridge including a casing for accommodating toner therein;

a main memory; and a controller, wherein, when image formation is performed, the controller is configured to perform:

counting at least one of a cumulative dot count and a first cumulative printed sheet number, the cumulative dot count being indicative of a cumulative number of dots formed in the image formation using the toner cartridge attached to the main body, the first cumulative printed sheet number being indicative of a cumulative number of sheets printed in the image formation using the toner cartridge attached to the main body;

counting a second cumulative printed sheet number indicative of a cumulative number of sheets printed in image formation using the drum cartridge attached to the main body; and storing into the main memory the at least one of the cumulative dot count and the first cumulative printed sheet number, and the second cumulative printed sheet number, and wherein the controller is configured to perform:

a first process for determining a first printable sheet number on a basis of the at least one of the cumulative dot count and the first cumulative printed sheet number, the first printable sheet number being indicative of a number of sheets printable using the toner cartridge attached to the main body;

a second process for determining a second printable sheet number on a basis of the second cumulative printed sheet number, the second printable sheet number being indicative of a number of sheets printable using the drum cartridge attached to the main body;

a third process for determining a third printable sheet number indicative of a number of sheets printable using a new toner cartridge; and when determining that a sum of the first printable sheet number and the third printable sheet number is greater than or equal to the second printable sheet number, a fourth process for transmitting to a server a signal for ordering a new drum cartridge together with a new toner cartridge.

2. The image forming apparatus according to claim 1, wherein the controller is configured to further perform:

determining a remaining quantity of toner in the casing on a basis of the cumulative dot count, and wherein, when determining that the remaining quantity of the toner in the casing is smaller than or equal to a first threshold value, the controller is configured to perform the first process through the fourth process.

3. The image forming apparatus according to claim 1, wherein the toner cartridge attached to the main body further includes a developing roller, wherein, when the image formation is performed, the controller is configured to further perform:

counting a cumulative rotation number indicative of a cumulative number of rotations of the developing roller; and storing the cumulative rotation number into the main memory, and wherein, in the first process, the controller determines the first printable sheet number on a basis of at least one of the cumulative dot count, the first cumulative printed sheet number, and the cumulative rotation number.

4. The image forming apparatus according to claim 3, wherein, when calculating the first printable sheet number in the first process, the controller is configured to perform:

calculating a first value by:

multiplying a standard print sheet number of the toner cartridge attached to the main body by a standard per-sheet dot count and a cumulative printed sheet number in a prescribed period of time to obtain a first product, the standard print sheet number being indicative of a standard number of sheets printable using the toner cartridge attached to the main body, the standard per-sheet dot count being indicative of a standard number of dots formed per sheet, the cumulative printed sheet number in the prescribed period of time being indicative of a cumulative number of sheets printed in the prescribed period of time; and dividing the first product by a cumulative dot count in the prescribed period of time indicative of a cumulative number of dots formed in the prescribed period of time;

calculating a second value by:

multiplying the standard print sheet number by a standard per-sheet rotation number of the developing roller and the cumulative printed sheet number in the prescribed period of time to obtain a second product, the standard per-sheet rotation number of the developing roller being indicative of a standard number of rotations of the developing roller per sheet; and dividing the second product by a cumulative rotation number of the developing roller in the prescribed period of time indicative of a cumulative number of rotations of the developing roller in the prescribed period of time; and subtracting the first cumulative printed sheet number from the first value or the second value whichever is smaller to obtain the first printable sheet number.

5. The image forming apparatus according to claim 4, wherein the toner cartridge further includes a toner memory, and wherein the standard print sheet number of the toner cartridge attached to the main body and the standard per-sheet dot count are stored in the toner memory.

6. The image forming apparatus according to claim 1, wherein, when calculating the second printable sheet number in the second process, the controller is configured to perform:

calculating a third value by:

multiplying a standard print sheet number of the drum cartridge attached to the main body by a standard per-sheet rotation number of the photosensitive drum and a cumulative printed sheet number in a prescribed period of time to obtain a third product, the standard print sheet number being indicative of a standard number of sheets printable using the drum cartridge attached to the main body, the standard per-sheet rotation number of the photosensitive drum being indicative of a standard number of rotations of the photosensitive drum per sheet, the cumulative printed sheet number in the prescribed period of time being indicative of a cumulative number of sheets printed in the prescribed period of time; and dividing the third product by a cumulative rotation number of the photosensitive drum in the prescribed period of time indicative of a cumulative number of rotations of the photosensitive drum in the prescribed period of time; and subtracting the second cumulative printed sheet number from the third value or a fourth value whichever is smaller to obtain the second printable sheet number, the fourth value being indicative of the standard print sheet number of the drum cartridge.

7. The image forming apparatus according to claim 6, wherein the drum cartridge further includes a drum memory, and wherein the standard print sheet number of the drum cartridge attached to the main body and the standard rotation number of the photosensitive drum are stored in the drum memory.

8. The image forming apparatus according to claim 1, wherein the toner cartridge is attachable to the drum cartridge, and wherein the toner cartridge and the drum cartridge are attachable to the main body in a state where the toner cartridge is attached to the drum cartridge.

9. A server configured to communicate with an image forming apparatus, the image forming apparatus including a main body to which a toner cartridge and a drum cartridge are attachable, the server being configured to perform:

receiving, from the image forming apparatus, at least one of a cumulative dot count and a first cumulative printed sheet number, the cumulative dot count being indicative of a cumulative number of dots formed in image formation using the toner cartridge attached to the main body, the first cumulative printed sheet number being indicative of a cumulative number of sheets printed in the image formation using the toner cartridge attached to the main body;

receiving, from the image forming apparatus, a second cumulative printed sheet number indicative of a cumulative number of sheets printed in image formation using the drum cartridge attached to the main body;

determining a first printable sheet number on a basis of the at least one of the cumulative dot count and the first cumulative printed sheet number, the first printable sheet number being indicative of a number of sheets printable using the toner cartridge attached to the main body;

determining a second printable sheet number on a basis of the second cumulative printed sheet number, the second printable sheet number being indicative of a number of sheets printable using the drum cartridge attached to the main body;

determining a third printable sheet number indicative of a number of sheets printable using a new toner cartridge;

when determining that a sum of the first printable sheet number and the third printable sheet number is smaller than the second printable sheet number, ordering a new toner cartridge; and when determining that the sum of the first printable sheet number and the third printable sheet number is greater than or equal to the second printable sheet number, ordering a new drum cartridge together with a new toner cartridge.

* * * * *